United States Patent [19]

Stoltz

[11] 4,180,948

[45] Jan. 1, 1980

[54] INTERNAL PIPELINE CLEANING DEVICE

[76] Inventor: Woodrow W. Stoltz, P.O. Box 35103, Tulsa, Okla. 74135

[21] Appl. No.: 815,906

[22] Filed: Jul. 15, 1977

[51] Int. Cl.[2] ..... B24C 3/16

[52] U.S. Cl. ..... 51/411; 15/3.5

[58] Field of Search ..... 15/3.5 R; 51/411; 134/166 C, 167 C, 168 C, 169 C

[56] References Cited

U.S. PATENT DOCUMENTS

| | | | |
|---|---|---|---|
| 2,117,648 | 5/1938 | Bottorf | 51/411 |
| 2,303,088 | 11/1942 | Perkins | 51/411 X |
| 2,468,984 | 5/1949 | Krieg | 51/411 |
| 3,137,974 | 6/1964 | Kirkland | 51/411 X |
| 3,814,330 | 6/1974 | Masters | 134/167 C X |

*Primary Examiner*—Gary L. Smith

*Attorney, Agent, or Firm*—Head, Johnson & Chafin

[57] ABSTRACT

A device adapted to move through a pipeline for cleaning the inner periphery thereof and comprising a rotatable central hub member constructed of an abrasive resistant material and having a chamber therein for receiving a supply of abrasive material, a plurality of radial passageways extending outwardly from the chamber at an angle deviating from the perpendicular of the longitudinal axis of the hub, the radial passageways being in communication with the chamber for receiving the abrasive material therefrom whereby upon rotation of the device the abrasive material will be impinged against the inner periphery of the pipeline at an angle with respect to the perpendicular of the longitudinal axis of the pipeline.

6 Claims, 3 Drawing Figures

INTERNAL PIPELINE CLEANING DEVICE

BACKGROUND OF THE INVENTION

1. Field of the Invention

This invention relates to improvements in pipeline cleaning devices and more particularly, but not by way of limitation, to an apparatus for cleaning the inner periphery of a pipeline.

2. Description of the Prior Art

It is frequently necessary to clean the inner periphery of pipelines for many reasons, such as to remove scale or other deposits accumulated within the pipeline during extended periods of use. Considering the fact that most pipelines are usually long and extend over vast distances, it is extremely difficult to clean the interior walls thereof. There are many devices available today for moving longitudinally through the interior of pipelines and ejecting abrasive materials radially outwardly against the inner periphery of the pipe for "sand blasting" thereof. These devices have many disadvantages, however, in that the grit or abrasive material used in the devices usually hits the inner periphery of the pipe and is deflected back against the outer periphery of the jets or nozzles utilized in the blasting operation and quickly wears away the device itself.

SUMMARY OF THE INVENTION

The present invention contemplates a novel internal pipeline cleaning device particularly designed and constructed for overcoming the foregoing disadvantages. The novel device comprises a central hub member constructed of a suitable abrasion resistant material and is provided with a central chamber therein for receiving a supply of grit or other suitable abrasive material therein. An outer housing is secured to the hub for movement simultaneously therewith and a plurality of radial passageways extend outwardly through the hub and the outer housing to provide communication between the hub chamber and the exterior of the outer housing. The radial passageways are disposed at an angle deviating from the perpendicular of the longitudinal axis of the hub. The outer housing is secured to the usual rotatable hollow drive shaft of a suitable power source, with said hollow drive shaft being in communication with a supply of abrasive material, as is well known. The hub chamber is in communication with the interior of the hollow drive shaft when the outer housing is secured thereto, and the entire apparatus is adapted to be moved longitudinally through the pipeline in any well known manner. As the hollow drive shaft is rotated by the power source, the outer housing is rotated simultaneously therewith for transmitting rotation to the hub member. The abrasive material within the hub chamber is thrown into the radial passageways and against the inner periphery of the pipeline by centrifugal force. The particles strike the inner periphery of the pipeline at an angle with respect to the perpendicular of the longitudinal axis of the pipeline and are deflected away from the point of contact in a direction away from the outer periphery of the outer housing. Thus, relatively little of the grit, if any, is directed back against the outer surfaces of the device itself, but rather is deflected in a manner for impinging against the inner periphery of the pipe oppositely disposed with respect to the point of initial contact. It will be apparent that the abrasive material is utilized more efficiently in the pipe cleaning operation, and the useful life of the device is greatly prolonged. The novel internal pipeline cleaning device is simple and efficient in operation and economical and durable in construction.

DESCRIPTION OF THE PREFERRED EMBODIMENT

Figure 3:
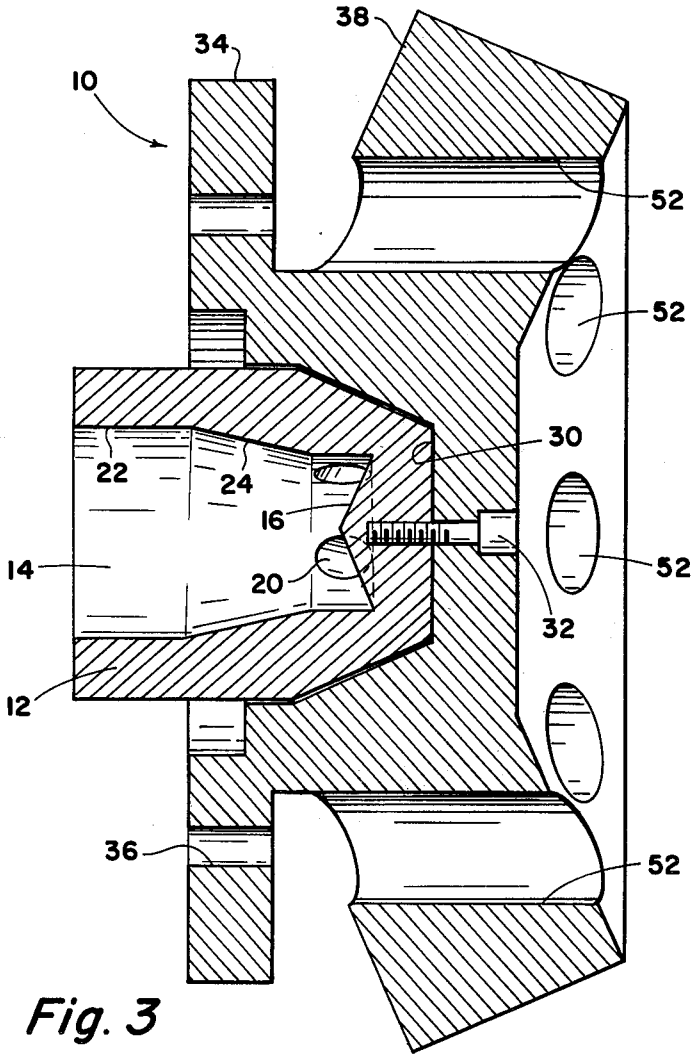
FIG. 3 is a sectional view taken on line 3—3 of FIG. 1.
Figure 2:
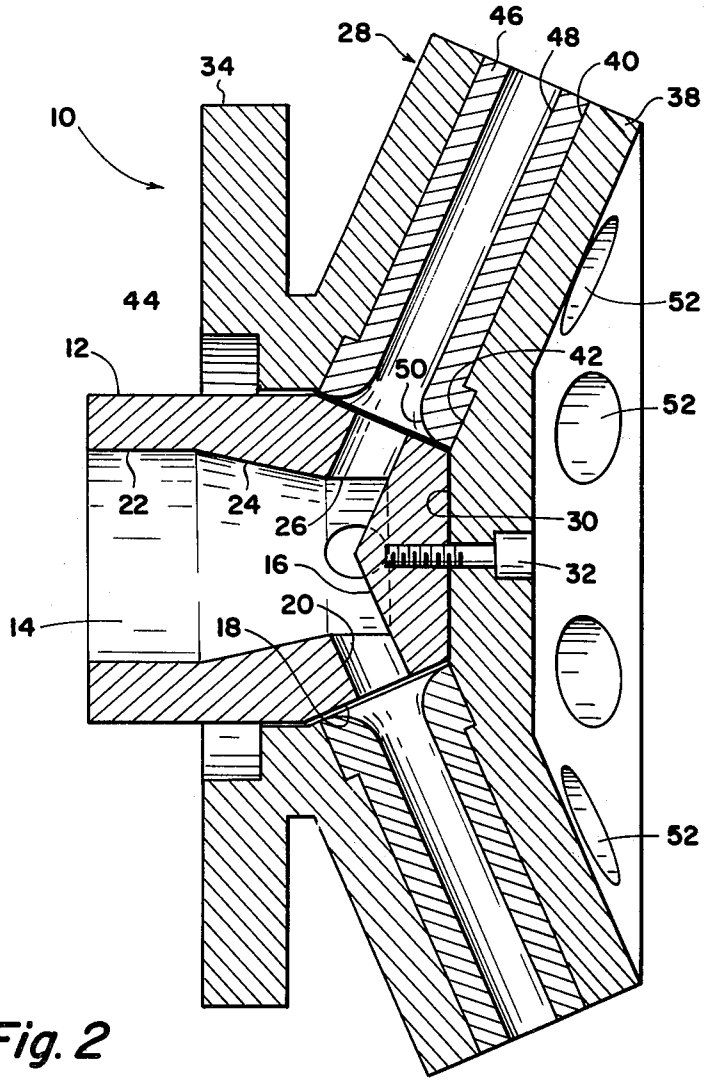
FIG. 2 is a sectional view taken on line 2—2 of FIG. 1.

Referring to the drawings in detail, reference character 10 generally indicates an internal pipe cleaning device comprising a central hub member 12 having an internal chamber 14 provided therein, said chamber being open at one end and closed at the opposite end by a substantially conical shaped wall 16. The hub member 12 is preferably constructed from or internally lined with a suitable abrasion resistant material, as is well known, and is provided with a substantially cylindrical outer periphery throughout a portion of the length thereof which is conterminous with a substantially frustrum-shaped portion 18 at the inner end thereof, as particularly shown in FIGS. 2 and 3. A plurality of circumferentially spaced bores 20 are provided in the frustrum 18 and extend radially outwardly at an angle with respect to the perpendicular of the longitudinal axis of the hub 12. In addition, the inner periphery of the bore or chamber 14 is preferably substantially cylindrical in the proximity of the open end thereof as shown at 22, and is conterminous with a substantially frustrum-shaped portion 24 which terminates in a substantially cylindrical portion 26 of a reduced diameter in the proximity of the wall 16.

An outer housing, generally indicated at 28, is provided with a centrally disposed recess 30 of a configuration complementary to the outer configuration of the hub 12 for receiving the hub 12 therein. The housing 28 is removably secured to the hub 12 in any suitable manner, such as by a screw 12, whereby the hub 12 and housing 28 move simultaneously. An outwardly extending circumferential flange 34 having a plurality of circumferentially spaced bores 36 therein is provided at one end of the housing 28 whereby the device 10 may be bolted or otherwise secured to the usual hollow drive shaft (not shown) of a suitable or well known power source (not shown), such as a hydraulic motor, electric motor, air motor, or the like, as is well known in the industry. A substantially conical-shaped body portion 38 is spaced slightly from the flange 34 and is provided with a plurality of circumferentially spaced radially extending bores or passageways 40 which are disposed at an angle with respect to the perpendicular of the longitudinal axis of the hub 12, and preferably at an angle extending away from the open end of the chamber 14. The bores 40 are in substantial alignment with the bores 20 for a purpose as will be hereinafter set forth. Each bore 40 is enlarged at 42 in the proximity of the bore 20 for receiving the head member 44 of a sleeve member 46 which is inserted in each bore 40 and retained therein in any suitable manner (not shown). The sleeves 46 are preferably constructed from a suitable abrasive resistant material similar to the material from which the hub 12 is constructed, and each sleeve 46 is provided with a central passageway 48 extending longitudinally therethrough to provide communication between the respective bore 20 and the exterior of the housing 28. The inwardly directed end of each passageway 48 may be flared outwardly as shown at 50 for facilitating directing of material or particles from the bores 20 into the passageway 48 for a purpose and in a manner as will be hereinafter set forth.

Figure 1:
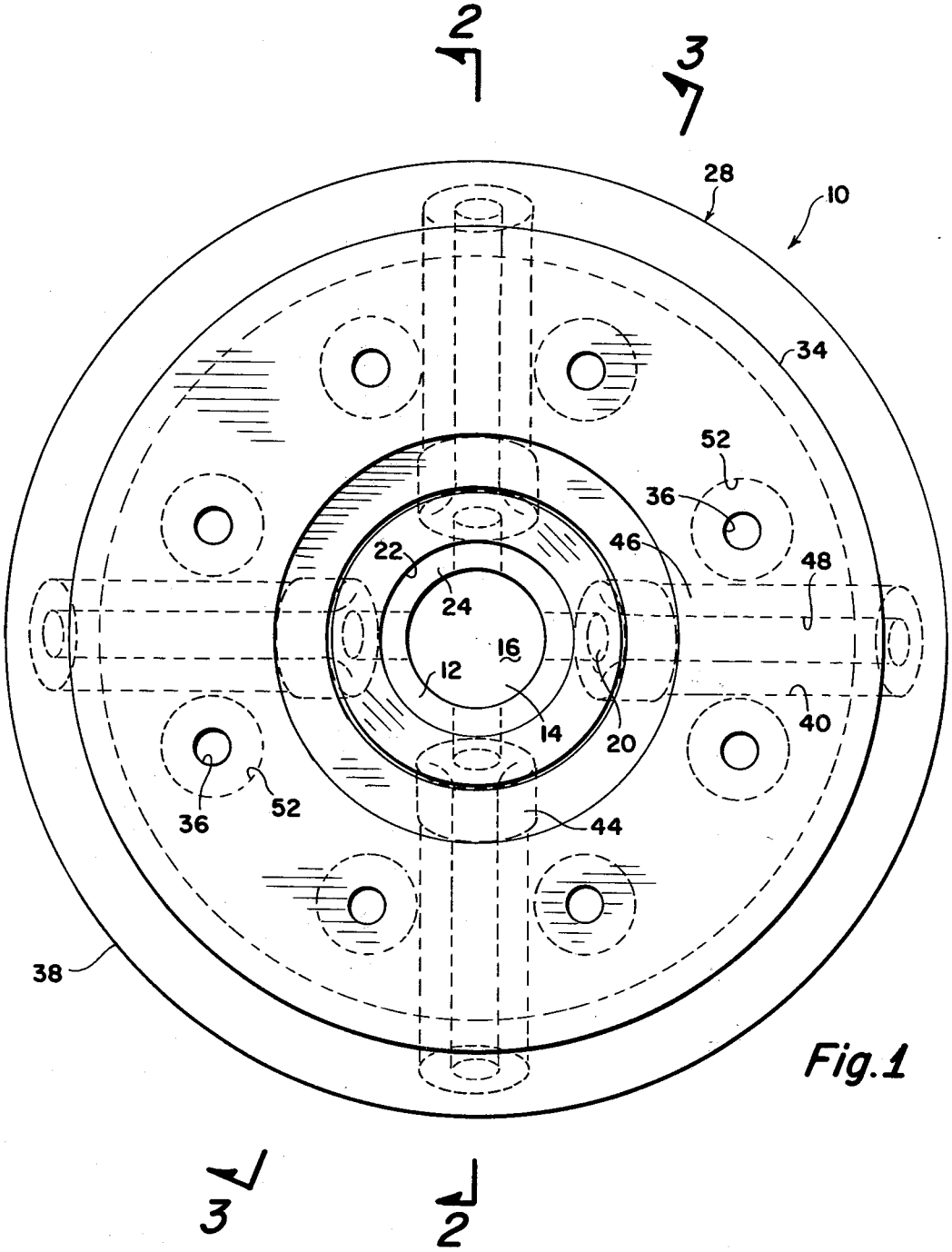
FIG. 1 is a front elevational view of an internal pipeline cleaning device embodying the invention.

In addition to the bores 40, a plurality of circumferentially spaced bores 52 are provided in the body 38 interposed between the bores 40, as particularly shown in FIG. 1. The bores 52 preferably extend substantially parallel to the longitudinal axis of the hub 12 and may be disposed in substantial alignment with the bores 36 of the flange 34, but not limited thereto. The bores 52 are provided in the body 38 for permitting the flow of fluid through and around the body 28 as the device 10 moves through a pipeline in order that movement of the device will not be hindered or restricted.

In use, the device 10 is bolted or otherwise secured to the hollow drive shaft (not shown) of a suitable power source (not shown) by the flange 34 as hereinbefore set forth and as well known. The entire apparatus may be moved longitudinally through the interior of the pipeline (not shown) in any well known manner (not shown). Of course, as the apparatus moves through the pipeline any fluid in the pipeline may flow through the bores 52 thus precluding restriction of movement of the apparatus therethrough.

The hollow drive shaft is normally in communication with a source of suitable abrasive material, such as grit (not shown), and when the flange 34 is bolted or otherwise secured to the hollow shaft, the hub member 12 is in substantial alignment with and may extend slightly within the interior of the hollow drive shaft whereby the grit will be admitted into the chamber 14 of the hub 12.

The outer housing 28 rotates simultaneously with the rotation of the hollow drive shaft of the power source, and the rotation of the housing 28 is transmitted to the hub 12 through the connection therebetween. As the grit is admitted to the internal chamber 14 of the rotating hub 12, the grit material is thrown against the inner periphery of the chamber 14 by centrifugal force, as is well known. The configuration of the inner periphery of the chamber 14, including the conical configuration of the wall 16, causes the grit to move in a direction toward the ports or bores 20, and the centrifugal force causes the grit to move outwardly through the bores 20 and into the passageways 48. Of course, the body 28 is also rotating, and the grit is thrown outwardly from the open outer ends of the passageways 48 in a direction substantially corresponding to the longitudinal axis of the passageways 48. The grit is thus impinged against the inner periphery of the pipeline (not shown) at an angle with respect to the vertical, or with respect to the perpendicular of the longitudinal axis of the pipeline and is deflected from the inner periphery of the pipeline in a direction away from the device 10. In fact, since the passageways 48 are preferably angularly disposed in a direction away from the open end of the chamber 14, the grit will be deflected from the initial point of contact with the inner periphery of the pipeline in a direction away from the device 10, regardless of the direction in which the device 10 moves through the pipeline. The deflected grit will be impinged against the inner periphery of the pipeline substantially oppositely, but angularly, disposed from the initial point of contact, thus increasing the efficient use of the grit.

From the foregoing it will be apparent that the present invention provides a novel internal pipeline cleaning device wherein grit or other abrasive material is impinged against the inner periphery of the pipeline in a manner for efficient use of the grit and for substantially precluding damage of the device itself by contact with the grit. The novel device comprises a contral hub member having an internal grit receiving chamber therein which is in communication with a source of grit through the usual hollow drive shaft of a suitable power source, such as a hydraulic motor, electric motor, air motor, or the like. An outer housing is secured to the hub for simultaneous movement therebetween, and the outer housing is secured to the hollow drive shaft for rotation thereby. A plurality of radial outwardly extending passageways are provided in the device for impinging the grit material against the inner periphery of the pipeline. The passageways are disposed at an angle with respect to the perpendicular of the longitudinal axis of the device whereby the path of the grit material impinging against the inner periphery of the pipe is at an angle with respect to the perpendicular of the longitudinal axis of the pipeline in order that the grit is deflected in a direction away from the cleaning device and against the opposite side of the inner periphery of the pipeline, thus providing a more efficient use of the grit material and greatly prolonging the useful life of the cleaning device.

Whereas the present invention has been described in particular relation to the drawings attached hereto, it should be understood that other and further modifications, apart from those shown or suggested herein may be made within the spirit and scope of this invention.

What is claimed is:

1. An internal pipeline cleaning device for use in combination with a power source having a hollow drive shaft in communication with a supply of abrasive grit materials and comprising hub means having an internal chamber in communication with the interior of the hollow drive shaft for receiving the abrasive materials therefrom, outer housing means secured to the hub means for simultaneous movement therewith, means provided on the outer housing means for securing the outer housing to the hollow drive shaft for rotation thereby, complementary radial passageway means provided in the hub means and outer housing means having one end in communication with the exterior of the outer housing in the proximity of one end thereof, said radial passageway means being disposed at an angle with respect to the perpendicular of the longitudinal axis of the hub means whereby upon rotation of the hollow drive shaft the abrasive materials will be thrown outwardly through the radial passageways from the internal chamber by centrifugal force in a combined angular and longitudinal direction away from the device for impinging against the inner periphery of the pipeline at an angle with respect to the perpendicular of the longitudinal axis of the pipeline and at a point spaced from the device.

2. An internal pipeline cleaning device as set forth in claim 1 wherein the hub means is constructed from an abrasion resistant material.

3. An internal pipeline cleaning device as set forth in claim 2 wherein internal liner means is provided for the radial passageway means, said internal liner means being constructed from an abrasive resistant material.

4. An internal pipeline cleaning device as set forth in claim 1 wherein the radial passageway means comprises a plurality of circumferentially spaced radially extending angularly disposed bores provided in the hub means and in communication with the internal chamber, and a plurality of circumferentially spaced radially extending angularly disposed bores provided in the outer housing means in substantial alignment with the first mentioned radial bores and having one end open to the first mentioned radial bores and the opposite end open to the exterior of the outer housing in the proximity of one end thereof.

5. An internal pipeline cleaning device as set forth in claim 1 and including a plurality of circumferentially spaced longitudinally extending bores provided in the outer housing for permitting the flow of fluid through the device upon movement thereof through the interior of the pipeline.

6. An internal pipeline cleaning device as set forth in claim 1 wherein the configuration of the inner periphery of the internal chamber includes means for directing the abrasive material in a direction toward the radial passageway means.

* * * * *